US009631891B2

(12) United States Patent
Sullivan

(10) Patent No.: US 9,631,891 B2
(45) Date of Patent: Apr. 25, 2017

(54) AIRSOFT KIT TO CONVERT TO A PAINTBALL GUN

(71) Applicant: Brian Sullivan, Alta Loma, CA (US)

(72) Inventor: Brian Sullivan, Alta Loma, CA (US)

( * ) Notice: Subject to any disclaimer, the term of this patent is extended or adjusted under 35 U.S.C. 154(b) by 0 days.

(21) Appl. No.: 14/824,802

(22) Filed: Aug. 12, 2015

(65) Prior Publication Data

US 2016/0047621 A1 Feb. 18, 2016

Related U.S. Application Data

(60) Provisional application No. 62/036,543, filed on Aug. 12, 2014.

(51) Int. Cl.

| | |
|---|---|
| ***F41B 11/62*** | (2013.01) |
| ***F41B 11/721*** | (2013.01) |
| ***F41A 21/10*** | (2006.01) |
| ***F41B 11/55*** | (2013.01) |

(52) U.S. Cl.

CPC ..... *F41B 11/721* (2013.01); *F41A 21/10* (2013.01); *F41B 11/55* (2013.01); *F41B 11/62* (2013.01)

(58) Field of Classification Search

CPC F41B 11/70; F41B 11/72; F41B 11/73; F41B 11/721; F41B 11/55; F41B 11/62; F41A 11/02; F41A 21/10

USPC ..... 124/73, 77, 56, 84

See application file for complete search history.

(56) References Cited

U.S. PATENT DOCUMENTS

| | | | | |
|---|---|---|---|---|
| 2,117,935 | A * | 5/1938 | Benjamin | F41A 21/10 124/84 |
| 5,987,797 | A | 11/1999 | Dustin | |
| 6,357,331 | B1 * | 3/2002 | Dionne | F41A 11/02 42/77 |
| 6,494,195 | B2 * | 12/2002 | Perry | F41A 21/04 124/73 |
| 6,513,274 | B1 | 2/2003 | Vastag | |
| 6,637,420 | B2 | 10/2003 | Maritz | |
| 6,668,815 | B1 * | 12/2003 | Fernandez | F41A 11/00 124/83 |
| 6,698,128 | B2 * | 3/2004 | Kessler | F41B 11/00 124/83 |
| 6,769,209 | B2 * | 8/2004 | Mendoza-Orozco | F41A 21/10 42/77 |
| 7,076,905 | B2 * | 7/2006 | Zouboulakis | F41A 11/02 124/83 |
| 7,302,881 | B1 | 12/2007 | Tertin | |
| 7,562,478 | B1 | 7/2009 | Vastag | |

(Continued)

*Primary Examiner* — John D Cooper

(74) *Attorney, Agent, or Firm* — Kirk A. Buhler; Buhler & Associates

(57) ABSTRACT

Improvements in an airsoft kit to convert an airsoft gun to fire paintballs is disclosed. The airsoft kit to convert an airsoft gun to fire paintballs to fire paintballs. The firing of paintballs can be with firing individual paintballs, a burst of about three paintballs successive paintballs rapid fire as paintballs are sprayed in a general area of an opponent. The kit converts an airsoft gun to fire paintballs to handle feeding either airsoft projectiles or paintball projectiles depending upon the installed kit. The kit allows for a user to purchase a single reliable gun that can be used for either activity and then install or remove a fit that allows the gun to be used in either of the two activities. The conversion requires little or no tools and can be performed in the field as the user prepares for their next combat.

14 Claims, 6 Drawing Sheets

(56) References Cited

U.S. PATENT DOCUMENTS

| | | | | |
|---|---|---|---|---|
| 7,628,149 | B1 * | 12/2009 | Zarecky | F41A 21/04 124/58 |
| 7,658,186 | B2 * | 2/2010 | Yeh | F41A 11/02 124/73 |
| 7,735,409 | B1 | 6/2010 | Tertin | |
| 7,980,238 | B2 * | 7/2011 | Wood | F41A 11/02 124/73 |
| 8,397,706 | B2 * | 3/2013 | Wood | F41A 11/02 124/73 |
| 9,170,066 | B2 * | 10/2015 | Cort | F41B 11/70 |
| 2004/0089280 | A1 * | 5/2004 | Kunimoto | F41B 11/723 124/76 |
| 2005/0091901 | A1 * | 5/2005 | Perry | F41A 21/04 42/78 |
| 2008/0029076 | A1 * | 2/2008 | Liang | F41B 11/50 124/51.1 |
| 2008/0168973 | A1 * | 7/2008 | Levin | F41B 11/00 124/73 |
| 2009/0133681 | A1 * | 5/2009 | Yeh | F41A 11/02 124/56 |
| 2010/0059032 | A1 | 3/2010 | Zadra | |

* cited by examiner

AIRSOFT KIT TO CONVERT TO A PAINTBALL GUN

CROSS REFERENCE TO RELATED APPLICATIONS

This application claims the benefit of Provisional Application Ser. No. 61/036,543 filed Aug. 12, 2014 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a conversion kit for guns, including guns for use in the sport of airsoft and paintball. More particularly, the present conversion kit allows a gun used for airsoft to be converted to fire paintballs. The kit is reversible to allow the gun to fire airsoft projectiles.

Description of Related Art Including Information Disclosed under 37 CFR 1.97 and 1.98

Conventional firearms have a firing mechanism to fire a projectile and a barrel to direct the projectile in a desired direction. Guns are made for numerous purposes and include many designs, for example, rifles, shot guns, and hand guns. A broad array of different mechanisms for firing a projectile have been employed for various types of guns. For example, one type of gun is dependent on having a propellant combined with the projectile. In this type of gun, the firing mechanism detonates the propellant contained in the projectile, which launches the projectile along the barrel. This type includes shot guns, which fire cartridges comprised of shot packaged with explosive material, and conventional rifles, machine guns, and handguns, which shoot bullets comprised of a unitary slug packaged with explosive material in a casing.

Another method of firing a projectile uses a propulsion source separate from the projectile, such as compressed gas, including air, carbon dioxide, nitrogen, and others. Examples of such guns include, air riffles, BB guns, and paintball guns or "markers." These guns either include a pump for compressing ambient air or are adapted to receive compressed air from a source, such as a compressed gas cartridge or gas cylinder. Conventional paintball guns rely on such cartridges or gas cylinders for supplying compressed gas, including air, nitrogen and carbon dioxide.

A typical firearm is constructed to fire either airsoft projectiles or paintballs. Due to the different handling requirements for the different projectiles for airsoft and paintball guns a conversion kit for handling both of these types of projectiles does not exist. A number of patents have been made to address a gunpowder fired projectiles where the bullet or shotgun handling addresses these issues. Exemplary examples of patents that try to address this/these problem(s) are identified and discussed below.

U.S. Pat. No. 6,513,274 issued on Feb. 4, 2003 to Laszlo Vastag discloses a Removable System for Converting a Breach Loading Shotgun to a .22 Long Rifle. While this patent discloses changing the gun for different types of ammunition, the conversion only allows for firing a single projectile at a time and a user must individually load each bullet into the firearm.

U.S. Pat. Nos. 7,302,881, and 7,735,409 issued on Dec. 4, 2007 and Jun. 15, 2010 respectively, both to James A. Tertin disclose a Conversion Kit and Method for a Ruger 10/22 Semi-Automatic .22 Caliber Rim Fire Rifle to Shoot .17 Mach 2 Cartridges. Both these patents disclose firing bullets where the gun power is present in the cartridge. While the conversion allows the firearm to reload a projectile the gun powder in each bullet provides the forces to eject the fired shell and load another bullet.

U.S. Pat. No. 7,562,478 issued on Jul. 21, 2009 to Laszlo Vastag discloses a Firearm Conversion System and Caliber Reducer with Hammer Safety Lock. This system is for a revolver and includes a caliber reducer that is placed into the barrel of the firearm and the rotatable cylinder is replaced to accept the smaller caliber bullet. While this system allows for the firearm to fire different caliber projectiles, gun power is still the driving mechanism for the projectile and new projectiles are not self-loaded into the firearm.

U.S. Publication Number 2010/0059032 published on Mar. 11, 2010 to Lawrence J. Zadra discloses an Interchangeable Gun Barrel Apparatus and Method. In this publication the existing barrel of the firearm is removed and a completely new barrel is installed onto the firearm.

What is needed is a firearm that is configurable as an airsoft firearm that uses compressed gas for expelling a projectile and for loading new projectiles, and further includes a conversion kit to allow the firearm to also fire and reload paintballs using the same compressed gas. The disclosure found in this document provides a solution.

BRIEF SUMMARY OF THE INVENTION

It is an object of the airsoft kit to convert an airsoft gun to fire paintballs to feed and fire airsoft projectiles. The airsoft market is much larger than the paintball market, and often a person who uses a paintball gun may also use an airsoft gun. For these people purchasing two different guns for the different activities can be expensive. This is especially true when the user purchases high quality guns. In addition to the expense, a person becomes accustom the characteristics of a particular firearm and switching guns can alter the aim and feel from the perspective of the user.

It is an object of the airsoft kit to convert an airsoft gun to fire paintballs to fire paintballs. The activity of combat with paintball guns has grown in great popularity. The accuracy of a paintball gun is critical for marking an opponent. The firing of paintballs can be with firing individual paintballs, a burst of successive paintballs in rapid fire. This burst is typically about three paintballs of rapid fire as paintballs are sprayed in a general area of an opponent. The paintball guns provide a realistic appearance and weight of the paintball gun to simulate an actual combat firearm such as an AR-15 type rifle.

It is another object of the airsoft kit to convert an airsoft gun to fire paintballs to handle feeding either airsoft projectiles or paintball projectiles depending upon the installed kit. The kit allows for a user to purchase a single reliable gun that can be used for either activity and then install or remove a kit that allows the gun to be used in either of the two activities.

It is still another object of the airsoft kit to convert an airsoft gun to fire paintballs. The conversion requires little or no tools and can be performed in the field as the user prepares for their next combat. While it is unlikely that a user will utilize both airsoft projectiles and paintballs at the same time, a user may use the different types of projectiles in a single day as they switch between the two activities.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
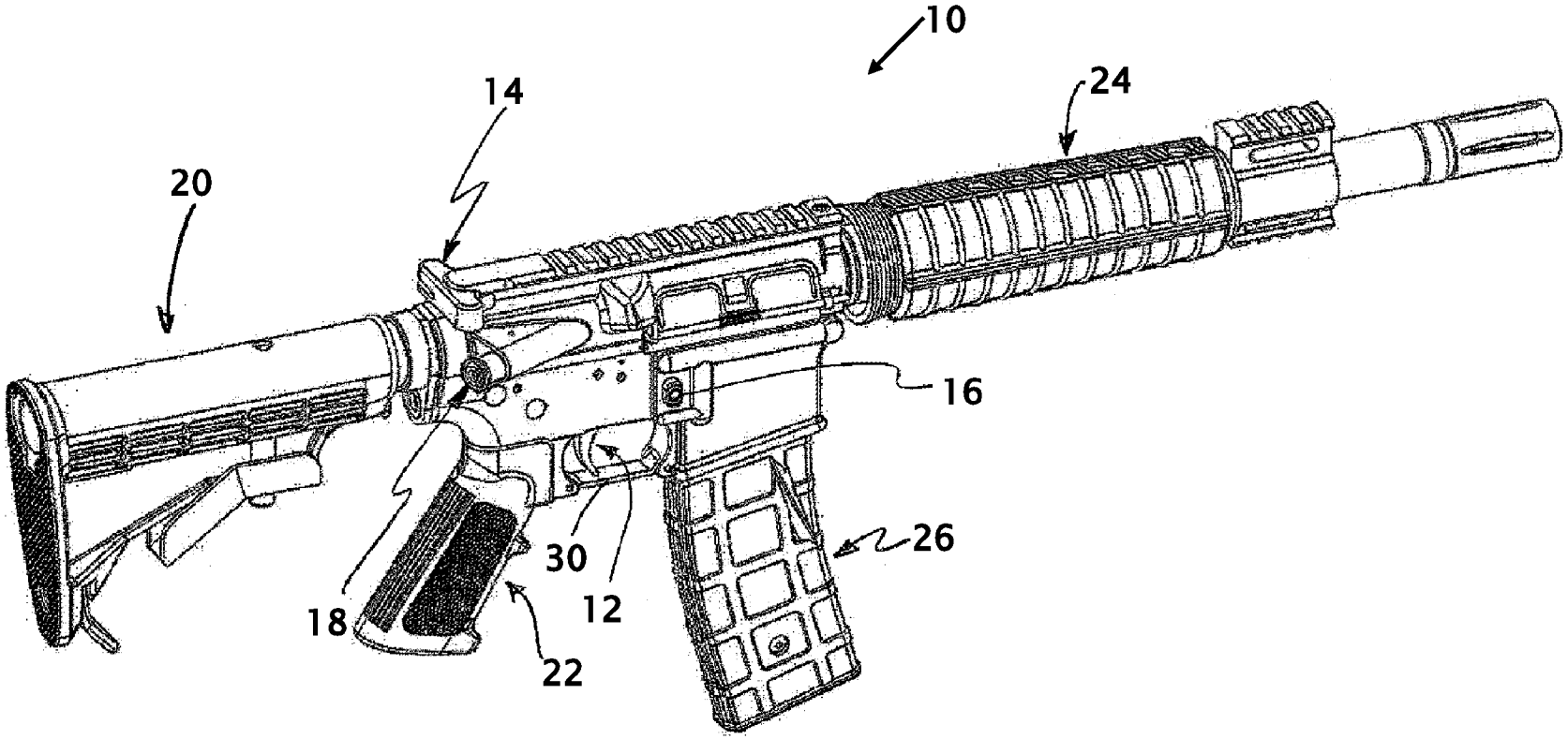
FIG. 1 shows a perspective view of a launcher 10.

FIG. 1 show a perspective view of a launcher 10. The projectile launcher 10 may support pneumatic actuation of one or more components thereof. For example, a launcher 10 may support pneumatic actuation or manipulation of an action thereof. Alternatively, or in addition thereto, pneumatic forces may be responsible for propelling a projecting out of a launcher 10

In selected embodiments, a launcher 10 may have an exterior look and feel that mimics, substantially matches, or matches the look and feel of a particular firearm (e.g., rifle, pistol, or the like). For example, as shown in FIG. 1, a launcher 10 may match or substantially match the exterior dimensions, look and feel, or the like of an AR-15 type rifle. A launcher 10 may also have external controls that match or substantially match the exterior controls of an AR-15 type rifle. Accordingly, a launcher 10 may provide an effective simulation or training platform.

For example, a launcher 10 may include a trigger 12, charging handle 14, magazine release 16, forward assist 18, butt stock 20 (e.g., adjustable butt stock), grip 22, fore grip 24, magazine 26, bolt release 28, trigger guard 30, selector-switch, or the like or a combination or sub-combination thereof that collectively or individually match or substantially match the operations, sizes, shapes, and/or relative positions of comparable components on an AR-15 type rifle. In certain embodiments, all such components may be functional. In other embodiments, certain components (e.g., a forward assist 18 and/or bolt release) may be provided merely to maintain aesthetic realism, but may otherwise be non-functional.

In certain embodiments, various components of a launcher 10 may be actual AR-15 parts. For example, in selected embodiments, a butt stock 20, grip 22, fore grip 24, trigger guard 30, or the like or a combination or sub-combination thereof may be actual AR-15 parts (e.g., "mil-spec" parts, aftermarket parts, or the like). Accordingly, a user may customize his or her launcher 10 in the same manner and/or with the same parts as he or she would with an actual AR-15 type rifle.

Figure 2:
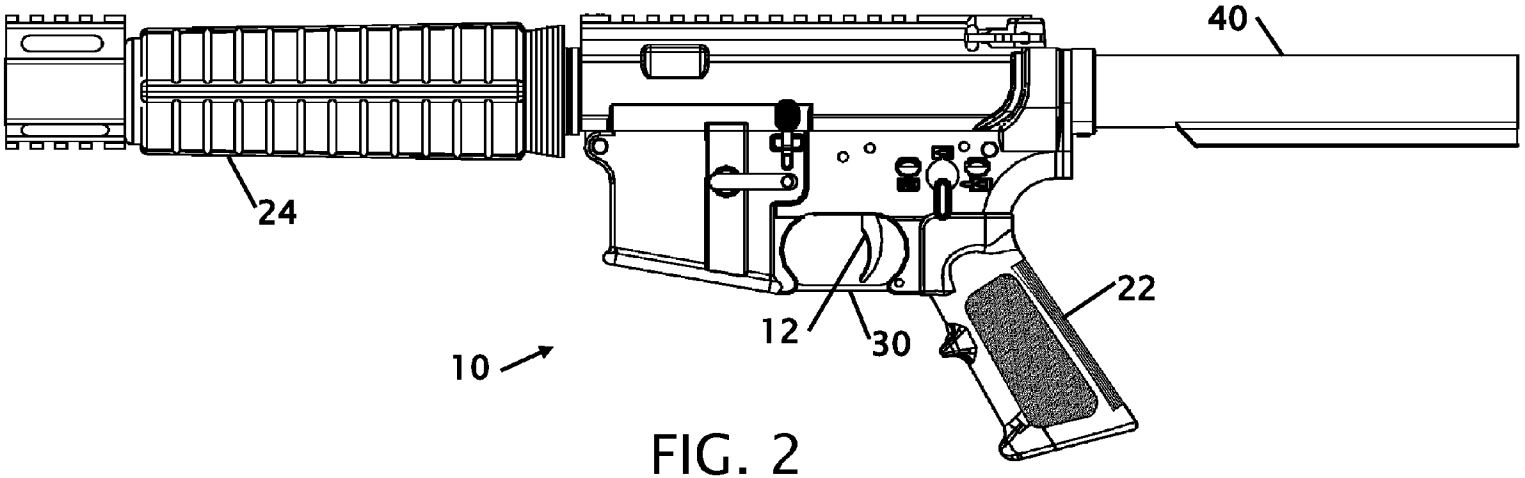
FIG. 2 shows a side view of the launcher with the unique internal items removed.
Figure 3:
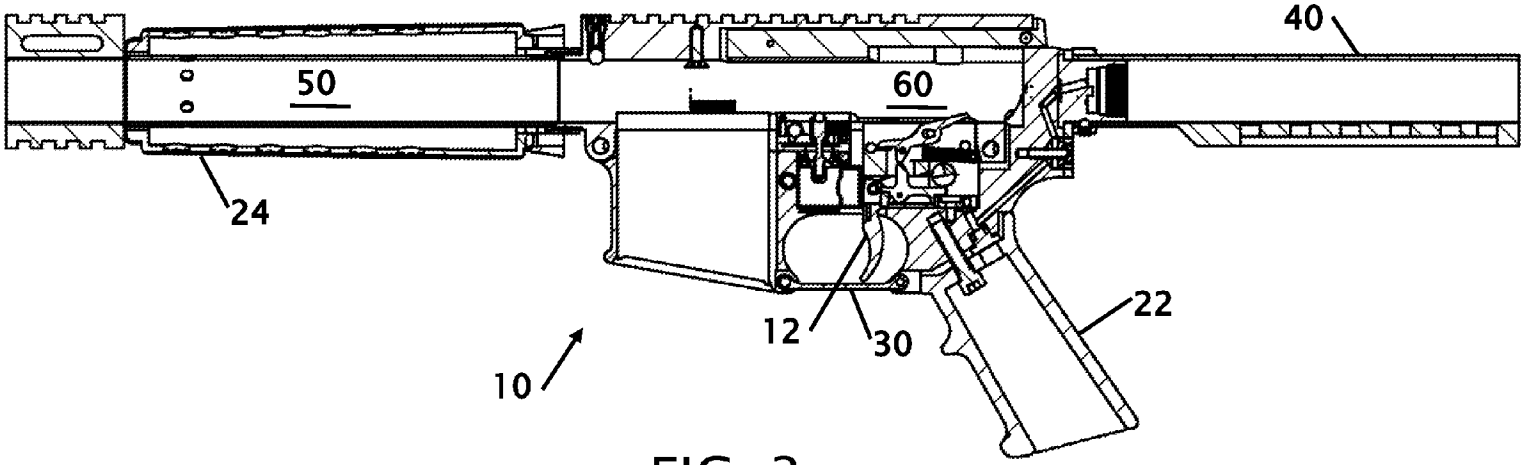
FIG. 3 shows a cross-section of the launcher from FIG. 2.

FIG. 2 shows a side view of the launcher 10 with the unique internal items removed and FIG. 3 shows a cross-section of the launcher 10 from FIG. 2. From FIG. 3 the entire barrel 50 inside of the fore grip 24 and the breach area 60 is clear to accept the transportation and firing components that allows the launcher 10 to fire either paintballs or airsoft projectiles. The trigger 12 under the trigger guard 30 and the firing mechanism that transports compressed gas stored in the chamber 40 in the butt stock to behind a projectile remains essentially intact. Even the grip 22 is the same in both versions. This allows a user to hold and fire either type of projectile from the same weapon shell.

Figure 4:
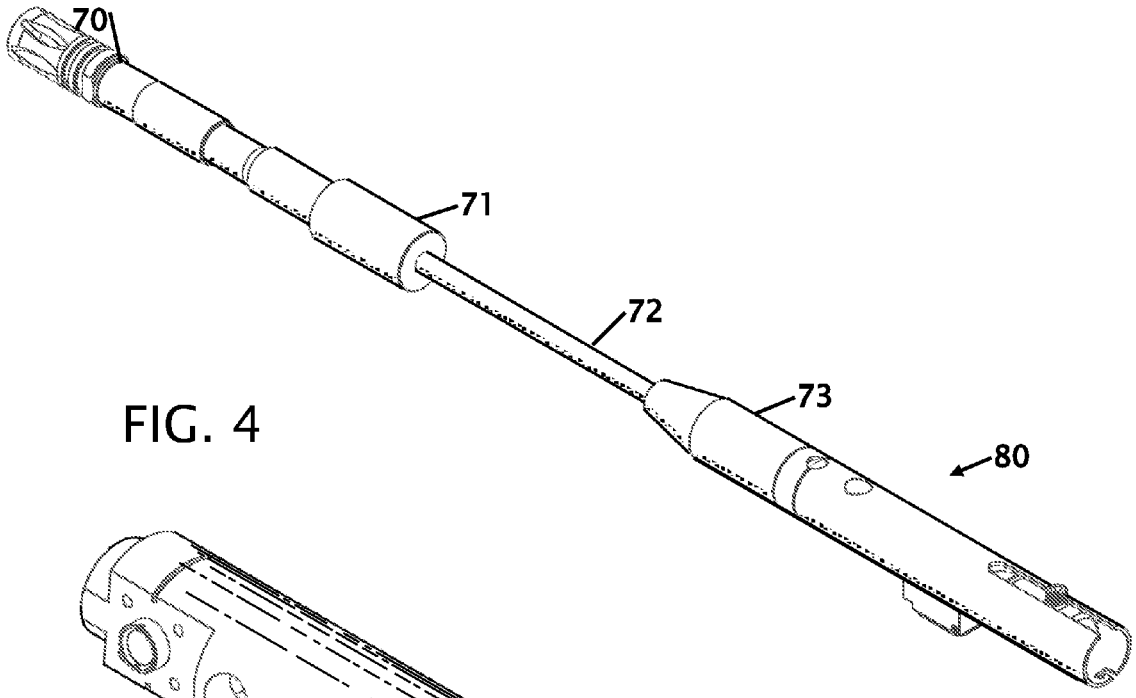
FIG. 4 shows an airsoft barrel.

FIG. 4 shows an airsoft barrel. This barrel has the breach 73 on the lower right portion of this figure. Connected to the breach 73 the airsoft inner barrel 72 is secured. The airsoft inner barrel 72 is then connected to the airsoft barrel 71 that is then connected to the muzzle break 70. Inside these components in a hollow inside diameter where an airsoft pellet passes when fired. The diameter of the barrel reduces the inside diameter from a diameter that can pass a paintball to a diameter that can pass an airsoft pellet. The airsoft pellet is loaded and fired from the breach. The breach 73 is installed into the airsoft sleeve shown in FIGS. 5 and 6. The inner diameter of said launcher is between .43 caliber and .68 caliber for the paintballs. .68 caliber or .68 inches in diameter being the most common.

Figure 5:
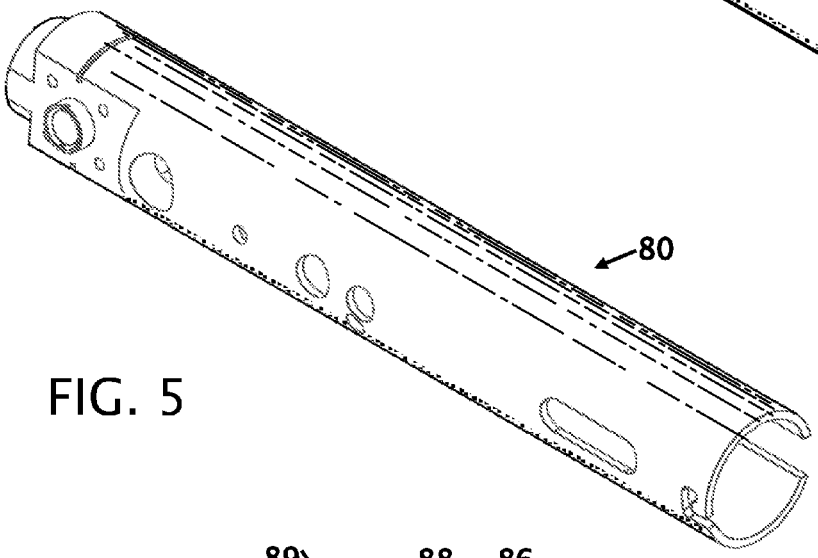
FIG. 5 shows an airsoft sleeve module.
Figure 6:
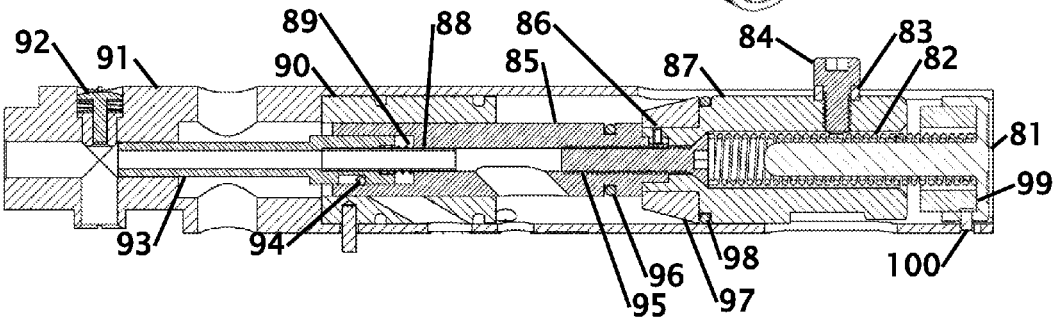
FIG. 6 shows a cross-section of the airsoft module from FIG. 5.

FIG. 5 shows an airsoft sleeve module 80 and FIG. 6 shows a cross-section of the airsoft sleeve module 80 from FIG. 5. The airsoft sleeve module controls the passage of pressurized gas from the gas cartridge to load and propel an airsoft pellet. The entire airsoft sleeve module 80 is configured to fit within the diameter of the gun that would normally allow a paintball to pass through the same diameter. Starting at the back of the airsoft sleeve module 80 there is a rear cap 81 that fits within the body of the firearm. A rear cap pin 100 secures the outside of the sleeve 91 to a striker cushion and the rear cap 81. A striker spring 82 is shown in the cocked orientation. The striker cushion 99 softens impact of the striker onto the rear cap 81.

A screw 84 passes through the sleeve 91 and into the striker 87. Screw 84 is located in a slot to allow the striker 87 to move in the sleeve 91. An O-ring 98 seals the movement of the striker 87. On the other side of the O-ring 98 a striker front 97 is located. The striker front 97 is secured with the airsoft bolt 85 that secures the striker front 97 to the screw 95. Roll pin 86 is for timing and orientation of the airsoft bulkhead 90 and the airsoft bolt 85. A bolt shaft O-ring 96 seals the airsoft bolt 85 within the airsoft sleeve module 80. A screw 95 passes into the inside diameter of the airsoft bolt 85.

A brass tube 88 is fitted into the bolt spring 89 where a cross pin 94 hold the inner bolt spring to the brass tube 88. At the opposing end of the airsoft sleeve module 80 the bolt tube 93 is secured in the airsoft sleeve module 80 with a retainer 92. When the trigger is pulled air passes into the airsoft sleeve module 80 to launch an airsoft pellet. The same internal area is used to propel a paintball in a similar manner. Airsoft pellets airsoft pellets have a diameter of essentially either 6 mm or 8 mm.

Figure 7:
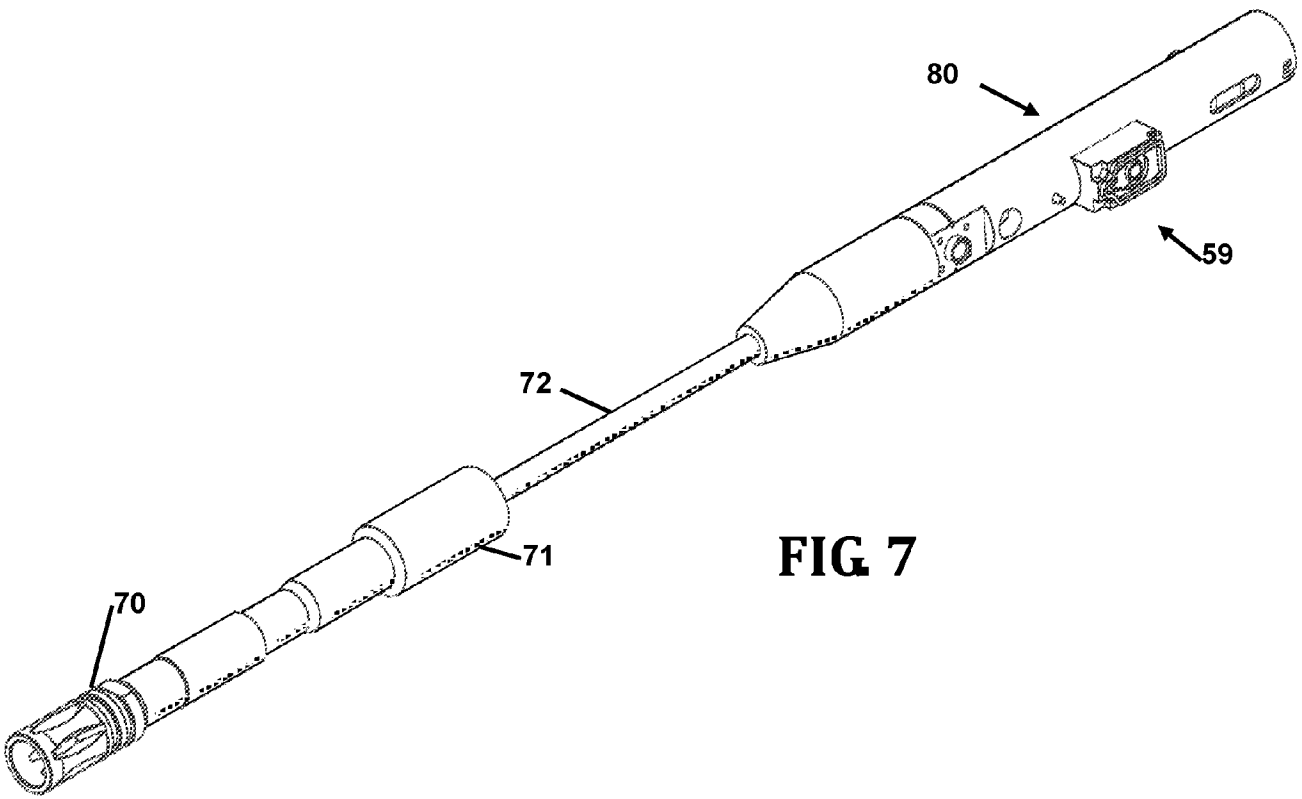
FIG. 7 shows an assembly of the barrel from FIG. 4 and the airsoft sleeve module from FIG. 5.
Figure 8:
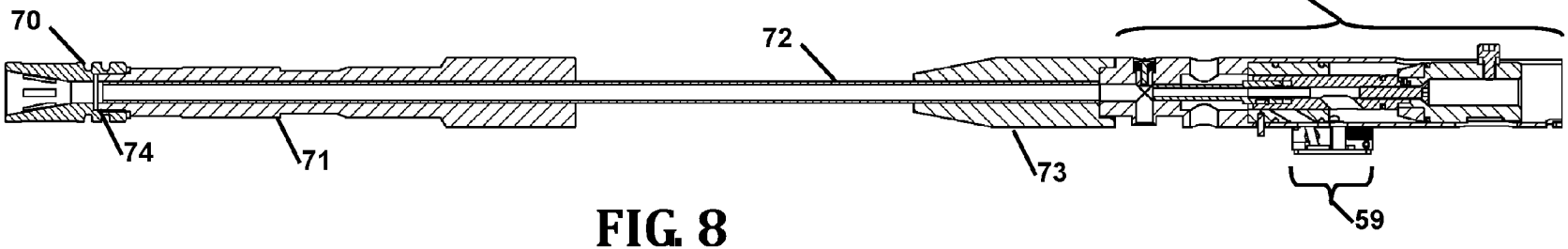
FIG. 8 shows a cross-section of the barrel and sleeve assembly from FIG. 7.

FIG. 7 shows an assembly of the barrel from FIG. 4 and the airsoft sleeve module from FIG. 5 and FIG. 8 shows a cross-section of the barrel and sleeve assembly from FIG. 7. These components are secured within the barrel and body of the paintball launcher to allow the paintball launcher to launch an airsoft pellet. From the right side of the figure the airsoft sleeve module 80 module is shown connected to the breach 73. On one side of the airsoft sleeve module 80 the airsoft Mag adapter 59 is shown.

Figure 9:
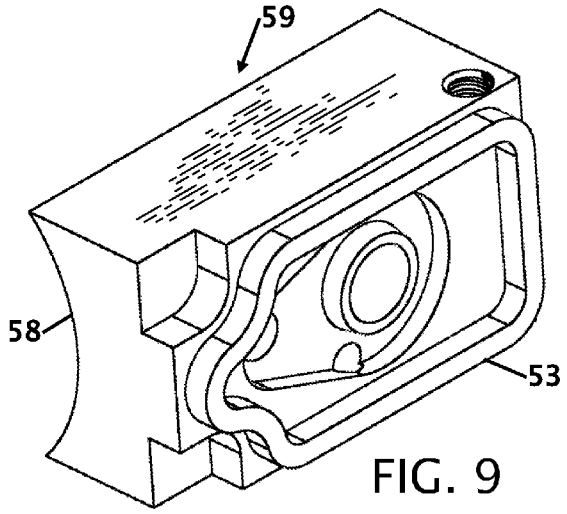
FIG. 9 shows an airsoft mag adapter.
Figure 10:
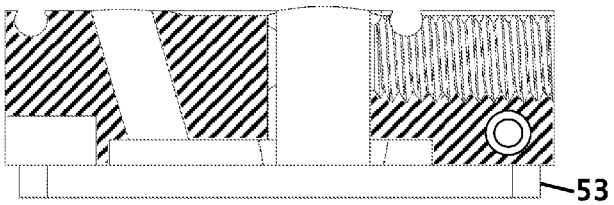
FIG. 10 shows a cross-section of the mag adapter from FIG. 9.

FIG. 9 shows an airsoft mag adapter 59 and FIG. 10 shows a cross-section of the airsoft mag adapter 59 from FIG. 9. The airsoft mag adapter 59 has a lower adapter plate 53 that forms the majority of the body of the airsoft mag adapter 59. A locator plate 58 both locates and helps to secure the airsoft mag adapter 59 on the airsoft sleeve module and within the launcher.

Figure 11:
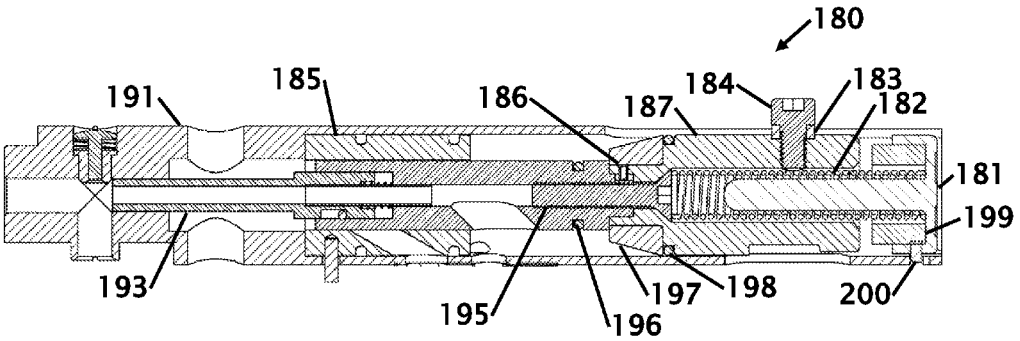
FIG. 11 shows a cross-section of the paintball sleeve module.

FIG. 11 shows a cross-section of the paintball sleeve module 180. The paintball sleeve module 180 controls the passage of pressurized gas from the gas cartridge to load and propel a paintball. The entire paintball sleeve module 180 is configured to fit within the diameter of the gun where the airsoft module could be located. Starting at the back of the paintball sleeve module 180 there is a rear cap 181 that fits within the body of the firearm. A rear cap pin 200 secures the outside of the sleeve 191 to a striker cushion and the rear cap 181. A striker spring 182 is shown in the cocked orientation. The striker cushion 199 softens impact of the striker onto the rear cap 181.

A screw 184 passes through the sleeve 191 and into the striker 187. Screw 184 is located in a slot to allow the striker 187 to move in the sleeve 191. An O-ring 198 seals the movement of the striker 187. On the other side of the O-ring 198 a striker front 197 is located. The striker front 197 is secured with the airsoft bolt 185 that secures the striker front 197 to the screw 195. A bolt shaft O-ring 196 seals the bulkhead 185 within the paintball sleeve module 180. A screw 195 passes into the inside diameter of the bulkhead 185. The bulkhead 185 retains the bolt 193 within the bulkhead sleeve 191. An O-ring seals the bolt 193 in the bulkhead sleeve 191.

Figure 12:
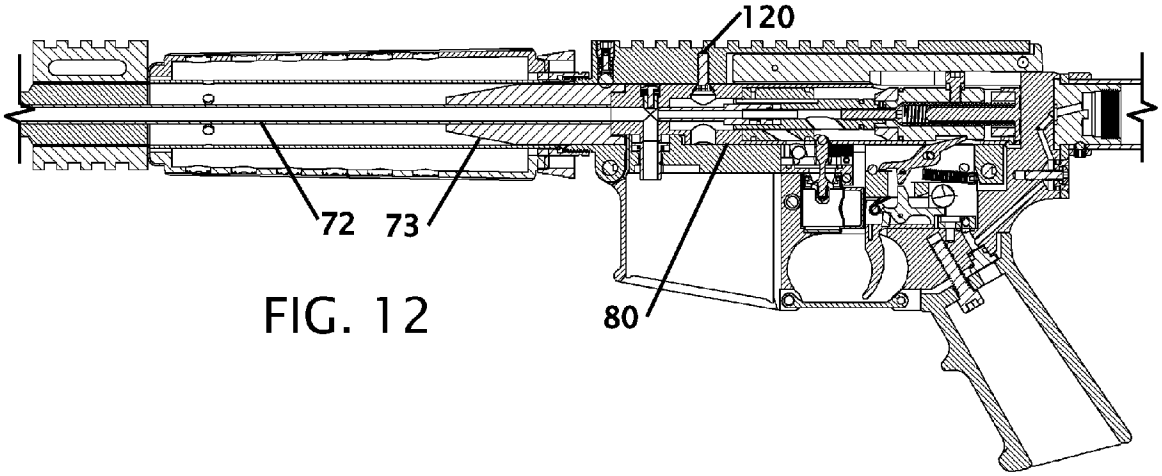
FIG. 12 shows a cross-section of the assembled airsoft launcher.

FIG. 12 shows a cross-section of the assembled airsoft launcher. This figures shows the breach 73 connected to the airsoft inner barrel 72 with the airsoft sleeve module 80. The airsoft inner barrel 72 is then connected to the airsoft barrel 71 that is then connected to the muzzle break 70. The airsoft sleeve module 80 is secured with screw 120 that is accessed through the ammunition loading opening. An airsoft mag adapter is also used with the configuration.

Figure 13:
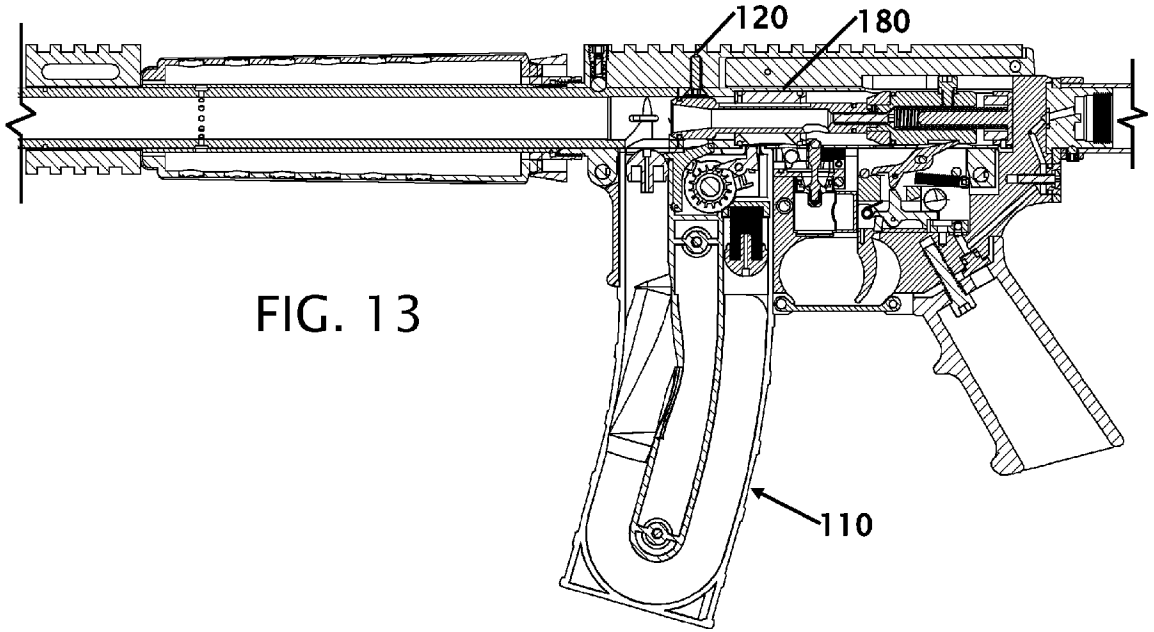
FIG. 13 shows a cross-section of the assembled paintball launcher.

FIG. 13 shows a cross-section of the assembled paintball launcher. The paintball sleeve module 180 is shown within the launcher. Again screw 120 secures the paintball sleeve module within the launcher. There is no inner barrel due to the diameter of a paintball. This figure further shows a clip feeding mechanism 110 that feeds paintballs into the paintball sleeve module 180.

Thus, specific embodiments of an airsoft kit to convert an airsoft gun to fire paintballs have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. An airsoft kit to convert an airsoft gun to fire airsoft pellets comprising:

a pneumatic launcher having interchangeable sleeve modules;

said pneumatic launcher with a paintball sleeve module with an inner diameter that allows launching of a paintball through said pneumatic launcher;

said pneumatic launcher having an airsoft sleeve module with a barrel that fits within said pneumatic launcher and is secured with a screw that is accessed through an ammunition loading opening within said pneumatic launcher;

said airsoft sleeve module transfers and loads individual pellets from a feeding mechanism to an airsoft inner barrel within said airsoft sleeve module;

a mag adapter having a locator plate secured to said airsoft sleeve module to locate and secure said airsoft sleeve module within said pneumatic launcher;

said airsoft sleeve module includes a bolt tube secured to a brass tube that is coupled with a bolt spring to an airsoft bolt;

said kit reduces said loading, chambering and launching of said pneumatic launcher from said inner diameter to a smaller diameter that fires said individual airsoft pellets, whereby said individual pellets are loaded and fired through a clip feeding mechanism from a breach in said pneumatic launcher to launch said individual airsoft pellets that are smaller in diameter than a paintball, and said airsoft sleeve module includes a striker and said airsoft bolt.

2. The airsoft kit to convert an airsoft gun to fire airsoft pellets according to claim 1 wherein said kit is temporally stored in said pneumatic launcher and removable to allow said pneumatic launcher to launch paintballs.

3. The airsoft kit to convert an airsoft gun to fire airsoft pellets according to claim 1 wherein said pneumatic launcher is configured in appearance as an AR-15.

4. The airsoft kit to convert an airsoft gun to fire airsoft pellets according to claim 1 wherein a fastener passes through said airsoft sleeve module and into said striker.

5. The airsoft kit to convert an airsoft gun to fire airsoft pellets according to claim 4 wherein said fastener is located in a slot wherein said striker moves within said airsoft sleeve module.

6. The airsoft kit to convert an airsoft gun to fire airsoft pellets according to claim 5 wherein an O-ring seals movement of said striker.

7. The airsoft kit to convert an airsoft gun to fire airsoft pellets according to claim 1 wherein said striker has a front that is secured to said airsoft bolt.

8. The airsoft kit to convert an airsoft gun to fire airsoft pellets according to claim 1 further includes a bolt shaft O-ring sealing a bulkhead within said pneumatic launcher.

9. The airsoft kit to convert an airsoft gun to fire airsoft pellets according to claim 1 wherein said airsoft sleeve module is secured with a fastener that is accessed through an ammunition loading opening.

10. The airsoft kit to convert an airsoft gun to fire airsoft pellets according to claim 1 wherein a breach fits within said inner diameter of said pneumatic launcher to join said airsoft sleeve module to said airsoft inner barrel.

11. The airsoft kit to convert an airsoft gun to fire airsoft pellets according to claim 1 wherein said airsoft pellets have a diameter of essentially 6 mm or 8 mm.

12. The airsoft kit to convert an airsoft gun to fire airsoft pellets according to claim 1 wherein said inner diameter of said launcher is between .43 caliber and .68 caliber.

13. The airsoft kit to convert an airsoft gun to fire airsoft pellets according to claim 1 wherein a cross pin holds said bolt spring to said brass tube.

14. The airsoft kit to convert an airsoft gun to fire airsoft pellets according to claim 1 wherein said airsoft bolt is further secured to a striker and cocked with a striker spring.

* * * * *